US008249764B2

(12) United States Patent
Bauer et al.

(10) Patent No.: US 8,249,764 B2
(45) Date of Patent: Aug. 21, 2012

(54) MOTORIZED WATERCRAFT WITH A CONTROL DEVICE

(75) Inventors: Ralf Bauer, Neckarsulm (DE); Jürgen Grimmelsen, Stuttgart (DE)

(73) Assignee: Rotinor GmbH, Stuttgart (DE)

( * ) Notice: Subject to any disclaimer, the term of this patent is extended or adjusted under 35 U.S.C. 154(b) by 1067 days.

(21) Appl. No.: 11/794,967

(22) PCT Filed: Jan. 10, 2006

(86) PCT No.: PCT/EP2006/000139

§ 371 (c)(1),
(2), (4) Date: May 16, 2008

(87) PCT Pub. No.: WO2006/074896

PCT Pub. Date: Jul. 20, 2006

(65) Prior Publication Data

US 2008/0269969 A1 Oct. 30, 2008

(30) Foreign Application Priority Data

Jan. 13, 2005 (DE) ..... 10 2005 001 817

(51) Int. Cl.
*B60L 3/00* (2006.01)

(52) U.S. Cl. ..... 701/21; 440/1; 440/6; 440/87

(58) Field of Classification Search ..... 701/21; 114/312, 313, 315, 316, 318, 328, 336, 337, 114/338, 55.5, 55.52, 55.55, 55.57, 55.58; 440/1, 2, 6, 84, 85, 86, 87
See application file for complete search history.

(56) References Cited

U.S. PATENT DOCUMENTS

| | | | | |
|---|---|---|---|---|
| 3,789,788 | A * | 2/1974 | Peroni | 114/315 |
| 4,864,959 | A * | 9/1989 | Takamizawa et al. | 114/315 |
| 5,105,753 | A * | 4/1992 | Chih et al. | 114/315 |
| 5,172,292 | A * | 12/1992 | Erlandson et al. | 361/92 |
| 6,024,068 | A * | 2/2000 | Nakase et al. | 123/198 D |
| 6,174,209 | B1 * | 1/2001 | Cooper | 440/12.5 |
| 6,352,045 | B1 * | 3/2002 | Takashima | 114/55.5 |
| 6,461,204 | B1 * | 10/2002 | Takura et al. | 440/6 |
| 6,682,372 | B2 | 1/2004 | Grimmeisen | |
| 6,857,918 | B1 * | 2/2005 | Lebreux et al. | 440/6 |
| 2002/0083880 | A1 * | 7/2002 | Shelton et al. | 114/312 |
| 2004/0059477 | A1 * | 3/2004 | Kish et al. | 701/21 |
| 2004/0079272 | A1 * | 4/2004 | Mah | 114/315 |

FOREIGN PATENT DOCUMENTS

| | | | |
|---|---|---|---|
| DE | 90 05 333.8 | U1 | 2/1991 |
| EP | 1 413 512 | A1 | 4/2004 |
| WO | 01/62347 | A2 | 8/2001 |

* cited by examiner

*Primary Examiner* — Khoi Tran
*Assistant Examiner* — Stephen Holwerda
(74) *Attorney, Agent, or Firm* — Pauley Petersen & Erickson

(57) ABSTRACT

The invention relates to a motorized watercraft with a control device (1) and with a drive unit (30) having a water propeller that is driven by an electric motor (31). The electric motor (31), an operating unit (10), a motor controller (20), a battery controller (50) and a battery (60) are placed in a vehicle hull, and the water propeller is mounted in a flow channel in the vehicle hull. In order to connect the controlling components and the components to be controlled by means of a system architecture, a system bus and of a man-machine interface, the invention provides that the operating unit (10), the motor controller (20), and the battery controller (50) are data-connected by means of a communications device controlled by the control device (1). This enables an, in particular, fail-safe transmission of data, a constant monitoring of the system components, and when required, an emergency shut-down.

14 Claims, 1 Drawing Sheet

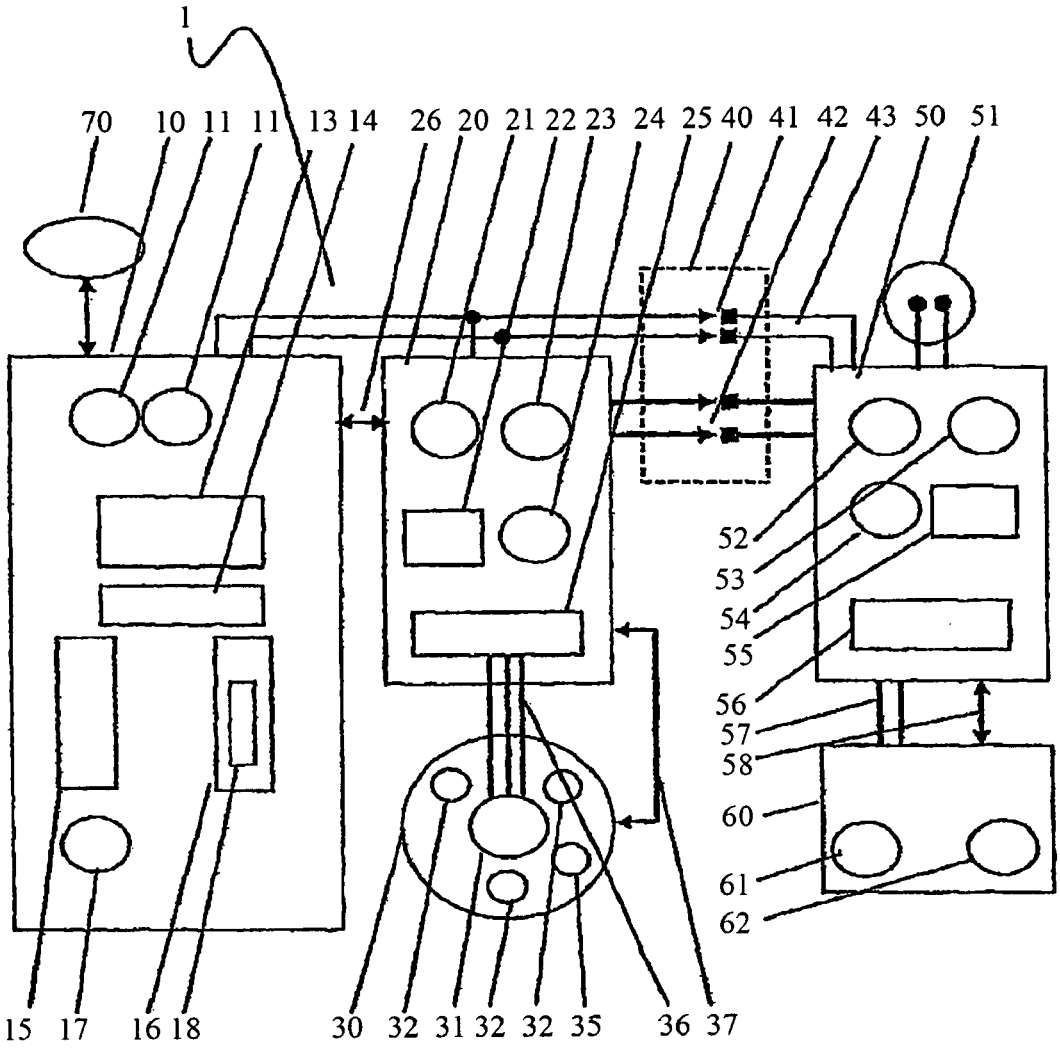
1
70
10
11
11
13
14
26
20
21
22
23
24
25
40
41
42
43
50
51
52
53
54
55
56
57
58
60
61
62
15
17
16
18
30
32
31
32
32
35
36
37

MOTORIZED WATERCRAFT WITH A CONTROL DEVICE

BACKGROUND OF THE INVENTION

1. Field of the Invention

This invention relates to a motorized watercraft with a control device and a drive unit, having a screw driven by an electric motor, wherein the electric motor, an operating unit, a motor control device, a battery control device and a battery are arranged in a vehicle body and the screw is arranged in a flow channel in the vehicle body.

The invention also relates to a method for operating a control device of a motorized watercraft, having a drive unit with a screw driven by an electric motor, wherein the electric motor, an operating unit, a motor control device, a battery control device and a battery are arranged in a vehicle body and the screw is arranged in a flow channel in the vehicle body.

2. Discussion of Related Art

A motorized watercraft within the meaning of this invention is a motor-driven watercraft wherein the person steering the watercraft is pulled on or below the surface of the water. The watercraft is used as a propulsion for a swimmer or a diver. Such a watercraft is also known as a wet-diving boat, because the swimmer or diver is not seated in a cabin, or even on the vehicle, but is in direct contact with the water.

A motorized watercraft is known from German Patent Reference DE 90 05 333, which has a cylindrical main body, in which the batteries and other control elements are arranged. The electric motor, as well as the screw, are attached to the stern in a ring-shaped body. This watercraft can be used for propelling a small boat, as well as a single person. In this case the flow created by the electric motor and the screw impacts the person to be transported.

A motorized watercraft is known from PCT International Publication WO 01/62347. In this case, the user lies on the vehicle body and the screw in the flow channel is driven by an electric motor supplied from batteries so that a water flow is drawn through the flow channel, which extends opposite a running direction of the watercraft. Thus, the water flow is kept away from the user and, with the shape of the vehicle body, can also be directed past the user. This makes swimming and diving with the watercraft easier. In this case a screw, an electric motor and a control device are combined into a unit and housed in the flow channel of the motorized water craft. This results in a substantial simplification regarding the construction and the maintenance of the watercraft. The batteries placed into a separate housing can be easily removed for the charging process and can be replaced by a fresh housing with charged batteries.

When used in accordance with its purpose, the watercraft is exposed to fresh and saltwater, temperature changes and exposure to water pressure. If the equipment is used in a rental facility, it is necessary to take special safety measures and differently trained users into consideration. It is necessary to avoid malfunctions of the equipment, which could harm the user, to the greatest extent.

SUMMARY OF THE INVENTION

It is one object of this invention to provide a watercraft of the type mentioned above but which, based on its system architecture, makes a particularly safe operation.

It is a further object of this invention to provide a method for a particularly safe operation of the watercraft available.

The object relating to the equipment is attained if the operating unit, the motor control and the battery control devices are brought into a data connection by a communications arrangement controlled by the control device. It is thus possible to achieve that the data transmission is particularly safe from interference, that continuous monitoring of the system components is performed and that an emergency shut-off can be performed when needed.

If data transmission contacts and power transmission contacts are combined in a releasable full-load pin-and-socket connector, it is possible to provide a sturdy releasable connection between the battery control and the motor control devices.

The system architecture is clear if the controlled communication device has a system bus for data exchange, because identical signals are available in all components and they all become simultaneously effective in case of changes.

If the system bus is designed as a two-wire system with bidirectional differential signal transmission, a dependable data transport can be achieved in spite of high medium-frequency currents in the motor control device and the drive unit and the connected electromagnetic interference effects.

If the controlled communication device has an RS-485 transmission arrangement, it is possible to use cost-effective standard components.

If the operating unit is a bus master, and the motor control and battery control devices are slaved bus devices, it is possible to achieve the data processing unit with a memory can monitor the data traffic and can detect an interruption. An emergency shut-off can be triggered in case of such an error.

If a wireless interface is provided for the data exchange between the control device and a service arrangement, it is possible to realize a data connection which is protected against water penetration.

A particularly advantageous embodiment provides for the wireless interface to be designed as a bidirectional infrared interface or other optical interface. Many portable computers are equipped with such an interface and thus can be employed for maintaining the motorized water equipment without being retrofitted.

If a timed multiplex method with a variable time raster for the transmitter and receiver is provided for the wireless interface, the available bandwidth is optimally utilized for the data traffic.

First-time loading of programs into the data processing arrangement and/or the motor control device and/or the battery control device, as well as updating of the programs, is possible without additional measures if the controlled communication device has bootstrap loader software for data transfer via the wireless interface.

If access authorization devices are provided for the data transfer via the wireless interface, it is possible to protect the programs against unauthorized access.

An embodiment with adaptation options of the operating parameters for trained operators, and extended authorizations for service personnel, provides access authorization for the access to internal parameters, measured values, settings and programming.

An embodiment protected against unauthorized opening and/or penetration by water allows the motor control device to have at least one optical sensor and at least one water sensor.

If the battery control device has at least one optical sensor and at least one water sensor, the motorized watercraft is protected against electrical malfunctions.

If watertight hidden operating elements are arranged on the control device, it is possible to trigger special functions, such as resetting the clock indicating the length of the lease, without opening the watertight sheathing of the equipment.

If an acoustical alarm arrangement is provided in the battery control device, it is possible to alert the operator regarding critical operational states, such as excess temperatures in components, or a malfunction.

One embodiment is suitable for leasing the motorized watercraft where a time-recording arrangement acts on the drive unit.

Maximum diving depth can be matched to the load-bearing capacity of the watertight sheathing of the motorized watercraft, as well as to the capabilities of the operator, if at least one water pressure sensor is arranged in the control device.

In a rugged embodiment of the operating element of the motorized watercraft, the operating unit has at least one handle with a hand grip sensor, and the hand grip sensor has a movably seated permanent magnet, which is in operative connection with two magnetic field sensors.

Self-monitoring of the operating element, and thus an embodiment of particular functional dependability can be achieved if an error detector by forming a summing signal from the two signals of the magnetic field sensors is provided in the hand grip sensor for the evaluation of the signals from the two magnetic field sensors.

One object of the method is attained if data are transmitted between the operating unit, the motor control device and the battery control device by a controlled communication arrangement. This makes possible the monitoring of the components and therefore a particularly dependable operation.

An increase in operational readiness by exchangeable batteries, simultaneously along with dependable operations by integrating the battery and an intelligent battery control, can be achieved if the data transfer and the power transmission is performed via a releasable full-load pin-and-socket connector. It is thus possible to transmit, besides the power transmission, also programs to the battery control device and to exchange parameters and data between the operating unit and the battery control device.

Dependable functioning is achieved, in case of an interruption of or interference with the controlled communication arrangement of more than 3 seconds, if the battery control device switches off the voltage at the full-load pin-and-socket connector completely. With this an endangerment of the operators, as well as damage to components, is prevented.

External electrical safety, as well as the protection of components, is improved with the electric motor stopped, when a maximum of 16 V, along with a current limitation of 500 mA, are switched through by the battery control device to the full-load pin-and-socket connector.

Searching for errors, as well as a decision in case of damage claims, is easier because diagnostic information regarding extreme values in connection with at least one of the states of temperature, current and water pressure, as well as at least one of the events of an open equipment, penetrated water, drive malfunction and sensor errors, is stored in the control device.

If during the triggering of an emergency stop, a command for the electric motor to stop is sent by the operating unit via the system bus to the motor control device, if the operating unit requests the number of revolutions of the electric motor via the system bus, if in case a number of revolutions greater than zero is detected a power stage of the motor control device is switched off, if in case of a number of revolutions greater than zero subsequently detected the voltage supply to the motor control device is switched off by an emergency shut-off signal, which is independent of the system bus, and then it is possible to achieve an emergency stop of the electric motor by several independent means and that a malfunction is very unlikely.

One embodiment, which is simple to operate, but yet satisfies safety regulations, provides for transporting the motorized watercraft with the charging device connected. A signal is output to the battery control device via the operating device, the battery control device checks the charge status of the battery and, with a charge state of more than 10% of maximum capacity, signals an error, and at a charge state of less than 10% the maximum capacity, starts a charging process up to 10% of maximum capacity.

If, for transporting the motorized watercraft, a command for changing into a transport mode is transmitted by the operating unit via the system bus to the battery control device, if the battery control device disconnects the operating voltage from the full-load pin-and-socket connector, and if all components in the battery control device, except for a safety controller are cut off from the electric current supply, then it is possible to achieve a safe transport, but the self-monitoring of the battery control device is still maintained.

If, in the transport mode, the safety controller monitors the voltage and temperature of the battery, as well as an optical sensor, it is possible when required during an impermissible operational state of the battery, such as excess temperature or a threat of a deep discharge, to issue a warning, and unauthorized opening of the battery control device can be written up.

If, in the transport mode, the safety controller monitors the voltage at the charging socket, and if, when connected with a charging device, it places the battery control device into the normal operating mode, the motorized watercraft can be switched from the transport mode into the normal operating mode without additional devices. Emerging from the transport mode takes place when the voltage of the charging device is located within a permissible voltage range.

BRIEF DESCRIPTION OF THE DRAWING

This invention is explained in greater detail in view of the exemplary embodiment represented in the drawing FIGURE which is a schematic representation of the control device for a motorized watercraft.

DETAILED DESCRIPTION OF THE INVENTION

A control device 1 for a motorized watercraft having an operating element 10 and a motor control device 20 controlled by it, which controls and monitors a drive unit 30 with an electric motor 31, is represented in FIG. 1. Via a full-load pin-and-socket connector 40, the drive unit 30 and the operating element 10 are connected with a battery control device 50, which controls and monitors the supply of the control device 1 from a battery 60.

The operating element 10 is used for inputting drive commands to the vehicle, which is suitable for operation on or under water, as well as for outputting information to the operator regarding the status of the vehicle. It is also used for the input of data for programs and parameters intended for the control device 1.

The user lies or stands on the vehicle and holds onto a left handle 15 and a right handle 16. Drive commands are issued by the right handle 16, which has a hand grip sensor 18. The hand grip sensor 18 comprises two magnetic field sensors arranged horizontally one behind the other in the traveling direction, and a permanent magnet which is arranged above them and vertically mounted and is suspended from a leaf spring, and has one pole located above the front magnetic field sensor in the traveling direction. The right handle 16 is inclined in the direction toward the operator for a drive order. Thus, the pole of the permanent magnet moves away from the front magnetic field sensor in the direction toward the rear magnetic field sensor. At maximum deflection, it is located directly above the rear magnetic field sensor. During the described movement of the right handle 16, the magnetic field at the front magnetic field sensor decreases continuously, while it continuously increases at the rear magnetic field sensor. Both signals are conducted to a data processing unit with a memory 14, which checks them for plausibility and derives drive orders from them. The plausibility check comprises a calculation of the measurement of a total magnetic field at both sensors and a comparison with upper and lower threshold values. If the total magnetic field lies outside of the threshold values, an error is assumed and an emergency stop is caused. The event is entered in the memory of the data processing unit with a memory 14.

If the operator pushes the right handle 16 forward, the energy supply of the drive unit, and thus the speed of travel, is reduced. If the operator releases the right handle 16, it returns into the front position and the energy supply of the drive unit 30 is switched off which also occurs if the operator leaves the watercraft against his or her will.

The operating unit 10 has an LC display 13 for communication with the operator. A water pressure sensor 17 is used for monitoring the diving depth of the equipment. If an adjustable maximum value is exceeded, the drive unit 30 can be temporarily switched off, so that the equipment rises to the lower diving depth because of its own buoyancy.

The operating element 10 has two operating element Hall sensors 11 which are arranged hidden, for special functions, which are not to be accessible to the operator. For example, these can be arranged to the left and right of the LC display 13. If they are activated by associated permanent magnets, a clock indicating the length of the rental can be reset, for example.

The operating element 10 communicates with the motor control device 20 and the battery control device 50 via a data bus. For reasons of electrical middle frequency currents possibly occurring in the motor control device 20, the motor control device 20 and the drive unit 30 are spatially separated from the operating unit 30, and the system bus is realized by bidirectional differential signal transmission technology, such as RS-485. The operating element 10 acts as the bus master on the bus, and the motor control device 20 and the battery control device 50 as bus slaves. The bus master transmits commands to the slaves and receives an acknowledgement for each query, which again contains the original query.

With this the bus master can determine whether a command reaches the slave and is correctly understood and processed. If the bus master detects an error, the user can resend the command or initiate safety measures, such as an emergency stop.

A bidirectional infrared interface 70 is installed in the operating element 10. Thus, it is possible to access the programs in the operating element 10, the motor control device 20 and the battery control device 50 from the outside, and new programs can be stored, if required. It is also possible to read out parameters from these units, or also write them therein. Bootstrap loader software is provided for this purpose in the data processing unit in the memory 14. There, authentication of the inputs is also performed by a PIN code. Different levels of authorization are provided for users, service and factory, which permit and block access to programming options and data. The length of lease for leased equipment and the maximum diving depth can also be set through the PIN-secured input. In this case, the maximum diving depth can be changed by the "user" with a PIN to the extent the limits set by the "factory" PIN permit this. The timer can count down after the lease time is set and can thus indicate the remaining length on the LC display 13 to the user. At a preset remaining length of time the output of the electric drive is reduced in order to signal the request for the return to the user in addition to the display, yet to make it possible for the user to return at reduced speed.

The commands from the operating unit 10 are passed on to the motor control device 20 via a regulator 22 to a power stage 25. The power stage 25 is monitored by a temperature sensor 24 and protected against an overload. The power stage 25 is connected with the drive unit 30 via a power transmission device 36 and a data transmission device 37.

The number of revolutions of the electric motor 31 is measured by motor Hall sensors 32 is passed on via the system bus 43 and is compared with desired values by the data processing unit containing the memory 14 in the operating unit 10. In case of a deviation from desired values, for example if, in spite of a command for reducing the number of revolutions of the electric motor 31 to zero via the system 43, the number of revolutions of the electric motor 31 does not return to zero, it is possible with the emergency shut-off signal 26, which acts independently of the system bus 43, to switch off the entire electric current supply of the motor control device 29 and to achieve the dependable stop of the motor.

The temperature of the electric motor 31 is continuously monitored by a temperature sensor 35, so that an emergency switch-off can take place.

With the drive mechanisms shut off, the power stage 25 can be completely switched off as a measure for energy savings.

The battery 60 and the associated battery control device 50 can be exchanged in order to provide a continuous readiness of the equipment, and a connection with the system bus is made via the full-load pin-and-socket connector 40 which has, besides two power transmission contacts 42, two data transmission contacts 41. Because of the design of the system bus as a serial bus, two data transmission contacts 41 are sufficient, and it is possible to select a particularly rugged plug-in connection with only four contacts. The battery 60 is connected with the battery control device 50 via a power transmission device 57 and a data transmission device 58. A safety controller 55 monitors the battery voltage and temperature by the temperature sensors 61, 62. In case of a danger of overheating, as well as of a possible deep discharge, the safety controller 55 issues a warning signal via an acoustic alarm device 54.

The safety controller monitors the full-load pin-and-socket connector 40 regarding a possible short circuit caused by saltwater or objects capable of conduction. For this purpose, with the motor stopped, the voltage at the power transmission contacts 42 can be limited to a safe value of 16 V, and the maximum current can be limited. In actual use, a value of 500 mA for the current limitation is proven to be suitable. Driving voltage is switched on as soon as the user operates the hand grip sensor. This is followed by the command from the operating unit for switching on the motor.

The safety controller also monitors the full-load pin-and-socket connector 40 regarding a disruption of the data transmission via the system bus 43 and, in case of a disruption of more than 3 seconds, switches off the voltage at the power transmission contacts 42.

The motor control device 20 and the battery control device 50 contain water sensors 23 and 53, so that in case of leakage of the units this event can be entered in the error memory of the data processing arrangement containing the memory 14 and the drive mechanism can be switched off. In case of water in the battery, an entry is also made in the memory of the battery control device, because the battery can also be operated separately from the operating unit. Thus, it is possible in case of the entry of water to stop operating in a dived state early, before the motorized watercraft sustains more extensive damage. The motor control device 20 and the battery control device 50 contain optical sensors 21 and 52, which detect the opening of the components and allow its recording in the data processing arrangement containing the memory 14. In case of water in the battery, an entry is also made in the memory of the battery control device, because the battery can also be operated separately from the operating unit.

Unauthorized opening of the equipment can thus be detected and can be used for finding the reason for possible damages.

The battery control device 50 can be connected with a charging device, not represented here, via a charging socket 51. If the safety controller 55 detects a suitable charging voltage at the contacts of the charging socket 51, the charging process which is monitored by a charging control device 56, of the battery 50 is started. During this, the safety controller 55 monitors the temperature of the battery 60 by temperature sensors 61 and 62. Because of the high capacity, a lithium-ion battery is preferably used as the battery.

For a transport by air, the full-load pin-and-socket connector 40 must be voltage-free and the charged state of the battery 60 can be at most 10% of its maximum capacity. In preparation, the user can send a signal via the system bus 43 to the safety controller 55 by the operating unit 10 and while the charging device is connected. If the momentary charging state is too high, a warning signal is emitted and the user must discharge the battery down to the permissible limit. If the charging state is below 10%, the battery 60 is charged to 10% of its maximum capacity. Thereafter, the safety controller 55 disconnects the voltage supply from the power transmission contacts 42 and the remaining users. Only the safety controller 55 itself remains active and monitors the voltage and temperature at the battery 60, as well as the light sensor 52. The control device 1 is ready to be transported.

For terminating the transport mode, the charging device is again connected. If the safety controller 55 discovers a permissible charging voltage, it reactivates the components of the control device 1 and initiates charging of the battery 60 up to a desired capacity.

With this system it is possible to achieve a dependable operation, even under critical operating connections, such as electromagnetic interferences, leakage at the full-load pin-and-socket connector 40 or in the housing of the motor control device 20 or the drive unit 30, and even in an event of a malfunction of the system bus 43.

The invention claimed is:

1. A method for operating a control device (1) of a motorized watercraft comprising:

grasping a handle (15, 16) connected to the motorized watercraft, the motorized watercraft having a drive unit (30) with a screw driven by an electric motor (31), wherein the electric motor (31), an operating unit (10), a motor control device (20), a battery control device (50) and a battery (60) are arranged in a vehicle body, the screw is arranged in a flow channel in the vehicle body, and data are transmitted between the operating unit (10), the motor control device (20) and the battery control device (50) by a controlled communication arrangement, wherein the handle (15, 16) includes a hand grip sensor (18) having a movably seated permanent magnet, which is in operative connection with two magnetic field sensors, wherein actuating the at least one handle with the hand grip sensor controls an energy supply to the drive unit (30);

performing data transfer and power transmission via a releasable full-load pin-and-socket connector (40) and wherein in case of the triggering of an emergency stop, a command for the electric motor (31) to stop is sent by the operating unit (10) via a system bus (43) to the motor control device (20), the operating unit (10) requests the number of revolutions of the electric motor (31) via the system bus (43), in case a number of revolutions greater than zero is detected a power stage (25) of the motor control device (20) is switched off, and in case of a number of revolutions greater than zero subsequently detected, the voltage supply to the motor control device (20) is switched off by an independent of the system bus.

2. The method in accordance with claim 1, wherein in case of one of an interruption of and an interference with the controlled communication arrangement of more than 3 seconds, the battery control device (50) completely switches off the voltage at the releasable full-load pin-and-socket connector (40).

3. The method in accordance with claim 2, wherein with the electric motor (31) stopped, the battery control device (50) limits the power transmission, to a maximum of 16 V, along with a current limitation of 500 mA, to the releasable full-load pin-and-socket connector (40).

4. The method in accordance with claim 3, wherein diagnostic information regarding extreme values in connection with at least one of states of temperature, current and water pressure, as well as at least one of events of an open equipment, a penetrated water, a drive malfunction and sensor errors is stored in the control device (1).

5. The method in accordance with claim 4, wherein for transporting the motorized watercraft with a charging device connected, a signal is output to the battery control device (50) via the operating unit (10), whereupon the battery control device (50) checks the charge status of the battery (60) and, with a charge state of more than 10% of maximum capacity, signals an error, and at a charge state of less than 10% of maximum capacity starts a charging process up to 10% of maximum capacity.

6. The method in accordance with claim 5, wherein for transporting the motorized watercraft, a command for changing into a transport mode is transmitted by the operating unit (10) via the system bus (43) to the battery control device (50), the battery control device (50) shuts off operating voltage from the full-load pin-and-socket connector (40), and all components in the battery control device (50) other than a safety controller (55), are cut off from an electric current supply.

7. The method in accordance with claim 6, wherein in the transport mode the safety controller (55) monitors the voltage and temperature of the battery (60), as well as an optical sensor (52).

8. The method in accordance with claim 7, wherein the safety controller (55) monitors the voltage at a charging socket (51) and when connected with the charging device places the battery control device (50) into the normal operating mode.

9. The method in accordance with claim 1, wherein with the electric motor (31) stopped, the battery control device (50) limits the power transmission, to a maximum of 16 V, along with a current limitation of 500 mA, to the releasable full-load pin-and-socket connector (40).

10. The method in accordance with claim 1, wherein diagnostic information regarding extreme values in connection with at least one of states of temperature, current and water pressure, as well as at least one of events of an open equipment, a penetrated water, a drive malfunction and sensor errors is stored in the control device (1).

11. A method for operating a control device (1) of a motorized watercraft comprising:

grasping a handle (15, 16) connected to the motorized watercraft, the motorized watercraft having a drive unit (30) with a screw driven by an electric motor (31), wherein the electric motor (31), an operating unit (10), a motor control device (20), a battery control device (50) and a battery (60) are arranged in a vehicle body, the screw is arranged in a flow channel in the vehicle body, and data are transmitted between the operating unit (10), the motor control device (20) and the battery control device (50) by a controlled communication arrangement, wherein the handle (15, 16) includes a hand grip sensor (18) having a movably seated permanent magnet, which is in operative connection with two magnetic field sensors, wherein actuating the at least one handle with the hand grip sensor controls an energy supply to the drive unit (30);

performing data transfer and power transmission via a releasable full-load pin-and-socket connector (40); and wherein for transporting the motorized watercraft with a charging device connected, a signal is output to the battery control device (50) via the operating unit (10), whereupon the battery control device (50) checks the charge status of the battery (60) and, with a charge state of more than 10% of maximum capacity, signals an error, and at a charge state of less than 10% of maximum capacity starts a charging process up to 10% of maximum capacity.

12. A method for operating a control device (1) of a motorized watercraft comprising:

grasping a handle (15, 16) connected to the motorized watercraft, the motorized watercraft having a drive unit (30) with a screw driven by an electric motor (31), wherein the electric motor (31), an operating unit (10), a motor control device (20), a battery control device (50) and a battery (60) are arranged in a vehicle body, the screw is arranged in a flow channel in the vehicle body, and data are transmitted between the operating unit (10), the motor control device (20) and the battery control device (50) by a controlled communication arrangement, wherein the handle (15, 16) includes a hand grip sensor (18) having a movably seated permanent magnet, which is in operative connection with two magnetic field sensors, wherein actuating the at least one handle with the hand grip sensor controls an energy supply to the drive unit (30);

performing data transfer and power transmission via a releasable full-load pin-and-socket connector (40); and wherein for transporting the motorized watercraft, a command for changing into a transport mode is transmitted by the operating unit (10) via a system bus (43) to the battery control device (50), the battery control device (50) shuts off operating voltage from the full-load pin-and-socket connector (40), and all components in the battery control device (50) other than a safety controller (55), are cut off from an electric current supply.

13. A method for operating a control device (1) of a motorized watercraft comprising:

grasping a handle (15, 16) connected to the motorized watercraft, the motorized watercraft having a drive unit (30) with a screw driven by an electric motor (31), wherein the electric motor (31), an operating unit (10), a motor control device (20), a battery control device (50) and a battery (60) are arranged in a vehicle body, the screw is arranged in a flow channel in the vehicle body, and data are transmitted between the operating unit (10), the motor control device (20) and the battery control device (50) by a controlled communication arrangement, wherein the handle (15, 16) includes a hand grip sensor (18) having a movably seated permanent magnet, which is in operative connection with two magnetic field sensors, wherein actuating the at least one handle with the hand grip sensor controls an energy supply to the drive unit (30);

performing data transfer and power transmission via a releasable full-load pin-and-socket connector (40); and wherein in a transport mode a safety controller (55) monitors the voltage and temperature of the battery (60), as well as an optical sensor (52).

14. A method for operating a control device (1) of a motorized watercraft comprising:

grasping a handle (15, 16) connected to the motorized watercraft, the motorized watercraft having a drive unit (30) with a screw driven by an electric motor (31), wherein the electric motor (31), an operating unit (10), a motor control device (20), a battery control device (50) and a battery (60) are arranged in a vehicle body, the screw is arranged in a flow channel in the vehicle body, and data are transmitted between the operating unit (10), the motor control device (20) and the battery control device (50) by a controlled communication arrangement, wherein the handle (15, 16) includes a hand grip sensor (18) having a movably seated permanent magnet, which is in operative connection with two magnetic field sensors, wherein actuating the at least one handle with the hand grip sensor controls an energy supply to the drive unit (30);

performing data transfer and power transmission via a releasable full-load pin-and-socket connector (40); and wherein a safety controller (55) monitors the voltage at a charging socket (51) and when connected with a charging device places the battery control device (50) into the normal operating mode.

* * * * *